US011124979B2

(12) United States Patent
Reavis

(10) Patent No.: US 11,124,979 B2
(45) Date of Patent: Sep. 21, 2021

(54) METHODS AND MEANS FOR IMPROVING THE INTERIOR SURFACES OF POOLS

(71) Applicant: Alliance Trading, Inc., Covington, LA (US)

(72) Inventor: Thurman Lynn Reavis, Charlotte, NC (US)

(73) Assignee: ALLIANCE TRADING, INC., Covington, LA (US)

( * ) Notice: Subject to any disclaimer, the term of this patent is extended or adjusted under 35 U.S.C. 154(b) by 0 days.

(21) Appl. No.: 15/427,633

(22) Filed: Feb. 8, 2017

(65) Prior Publication Data

US 2017/0145710 A1 May 25, 2017

Related U.S. Application Data

(63) Continuation of application No. 14/509,269, filed on Oct. 8, 2014, now abandoned.

(60) Provisional application No. 61/936,540, filed on Feb. 6, 2014, provisional application No. 61/901,850, filed on Nov. 8, 2013.

(51) Int. Cl.
*E04H 4/14* (2006.01)
*E04H 4/12* (2006.01)

(52) U.S. Cl.
CPC ..... *E04H 4/14* (2013.01); *E04H 4/1272* (2013.01); *E04H 2004/146* (2013.01)

(58) Field of Classification Search
CPC ..... E04H 4/14; E04H 2004/146; E04H 2004/147
USPC ..... 4/506
See application file for complete search history.

(56) References Cited

U.S. PATENT DOCUMENTS 4,356,933 A * 11/1982 Connolly ..... B65D 88/16 220/495.08
5,018,324 A * 5/1991 Lankheet ..... E04H 4/142 52/169.7
6,209,151 B1 * 4/2001 Schwimmer ..... E04H 4/0018 4/506
6,315,911 B1 * 11/2001 Radsky ..... E04H 4/1254 210/167.18
6,578,208 B1 * 6/2003 Lytle ..... E04H 4/1272 4/496
2003/0024039 A1 * 2/2003 Kindley ..... E04H 4/14 4/506

(Continued)

*Primary Examiner* — Lori L Baker
(74) *Attorney, Agent, or Firm* — Jason P. Mueller; FisherBroyles, LLP

(57) ABSTRACT

A liner for finishing an interior pool surface is disclosed, the liner including a water resistant material; and a predetermined decorative pattern or design, wherein the pattern or design is applied onto at least one side of the liner. The patterns and designs may be either two- or three-dimensional, and can include iridescent and/or reflective inks, reflective beads and/or pebbles and so on, and be arranged in either predetermined or randomized arrays. A customized pool skimmer face plate system is also disclosed, including at least a skimmer face plate cover; a template having a size and shape proportional to the size and shape of the face plate cover; a water-resistant material bearing a color, pattern, or design; and a wrapper created from the water-resistant material using the template that complements neighboring colors, patterns and designs surrounding the skimmer face plate installation location.

8 Claims, 7 Drawing Sheets

(56) References Cited

U.S. PATENT DOCUMENTS

2004/0061325 A1* 4/2004 Lyen ..... B41M 3/148
283/72
2006/0260035 A1* 11/2006 Baker, Jr. ..... E04H 4/1272
4/507

* cited by examiner

METHODS AND MEANS FOR IMPROVING THE INTERIOR SURFACES OF POOLS

CROSS-REFERENCE TO RELATED APPLICATIONS

The instant application is a continuation of U.S. Non-Provisional application Ser. No. 14/509,269 filed Oct. 8, 2014 (pending), which claims the benefit of prior U.S. provisional applications No. 61/901,850, filed Nov. 8, 2013 and Ser. No. 61/936,540, filed Feb. 6, 2014, the entirety of which are incorporated herein by reference.

FIELD OF THE INVENTION

The present invention relates generally to systems and materials for improving the interior surfaces of pools, and in a particular though non-limiting embodiment, to a simple, inexpensive, easily installed alternative to conventional gunite surfacing finishes upon or within which inks, beads and other decorative indicia are typically applied. The invention further includes a variety of improved pool skimmer face plate covers, and in a particular though non-limiting embodiment, to an apparatus and a method for producing customizable skimmer face plate covers that complement the pool's new or existing finish.

BACKGROUND OF THE INVENTION

Pools are an investment with many benefits. Pools not only allow friends, families and colleagues to make new memories and promote a healthy lifestyle through aerobic activity, they also greatly increase the aesthetic value of one's home or property and add value in nearly any setting.

Owning a pool is a relatively expensive investment to make and maintain, however, and pool owners expect their investments to reflect a high level of quality and aesthetics. There are, therefore, many enhancements a pool owner can make in order to improve the appearance of their pool.

For example, there are many styles and shapes of pools from which to choose—from a classic rectangular shape to Grecian-style, FIG. 8, round or oval, in-ground, above ground, and many others. Various types of decking can also be added, as well as other customizable features such as waterfalls, waterslides, water jets, rock décor, and fountain additions.

Presently known high-end in-ground pools frequently comprise gunite lower wall and flooring surfaces, with upper interior wall and flooring finishes created by applying decorative indicia to ceramic tiles and other finishing surfaces. Such indicia can include repetitive or randomized tile patterns, reflective inks, iridescent inks, reflective beads, and other attractive flourishes so that the walls and floor surfaces of the pool reflect and diffract light in an aesthetically pleasing manner Such flourishes brighten the pool area and enliven the swimming and lounging experience by enhancing the inherent beauty of the interplay between light and water, and allow customers to variably and selectively personalize their pools so that enjoyment and return on investment are maximized.

Such technology is costly and by its nature more or less permanently installed, however, and errors in installation and erosion caused by the elements and water chemistry can slowly erode the beauty and aesthetic enjoyment of the pool.

Above ground pools and in-ground vinyl liner pools suffer from the basic problems as gunite in-ground pools, except that they do not typically include erodible gunite surface finishing and ceramic tiling. Instead, such pools are usually fitted with liners in an attempt to soften and beautify interior presentation. Such liners, however, are frequently even more susceptible to weathering and environmental deconditioning. Consequently, replacement liners and lining materials tend to strongly emphasize functionality over aesthetics, and to date fail to reproduce the far more attractive design elements present in originally constructed in-ground gunite pools.

There is, therefore, a long standing unmet need for durable, cost-effective pool linings that will replace in-ground gunite and tile surfaces that better capture the aesthetics presently associated with more expensive, permanent construction in-ground pools.

Similarly, despite the vast improvements in the luxury details a pool owner may choose or modify, there is one aspect of the pool system that has heretofore stayed basically the same since industry inception—the skimmer cover.

Those of ordinary skill in the art will readily appreciate that pool skimmers generally help keep pools clean by skimming water and capturing floating debris, such as leaves, dirt, twigs, dead insects, and oils. Most pools include one or more prominently positioned skimmers within at least one of the pool's upper walls. Though essential to maintain sanitation and chemical balance, such skimmers are often considered an eyesore. Skimmers and their covers—typically exposed face plates attached to a wall surface around the perimeter of the skimmer opening—are usually industry standard white plastic plates that are glaringly obvious and which appear out of place in the streamlined pools of today, especially those pools that have colorful and intricately patterned linings or other interior surfaces.

Pool skimmer face plates therefore act to interrupt the fluid and otherwise aesthetically pleasing patterns of pool liners and gunite or ceramic patterning. All pools that have linings, such as a vinyl surfaced lining, require face plates to cover and seal around the skimmer to prevent water from penetrating behind the vinyl liner. These skimmer face plates are generally screwed to the skimmer, and the unsightly screws are usually also left visible. To add to their unattractiveness, skimmer face plates regularly discolor from exposure to swimming pool water and maintenance chemicals. For these reasons, skimmer face plates negatively impact the overall appearance and aesthetics of a pool.

Presently known skimmer face plates are available in standard white, light blue, gray or similar solid coloring. The lack of available skimmer face plate options prevents pool owners from customizing or camouflaging the unappealing skimmer face plates. There are currently no known skimmer face plate covers that allow for customization to match the skimmer face plate to the pool's decorative lining or other interior surface finishing.

There is, therefore, also a longstanding but presently unmet need for an apparatus and a method for providing customizable pool skimmer face plate covers.

SUMMARY

A liner for finishing an interior pool surface is disclosed, the liner including a water resistant material; and a predetermined decorative pattern or design, wherein the pattern or design is applied onto at least one side of the liner. The patterns and designs may be either two- or three-dimensional, and can include iridescent and/or reflective inks, reflective beads and/or pebbles, etc., and be arranged in either predetermined or randomized arrays.

A customized pool skimmer face plate system is also disclosed, including at least a skimmer face plate; a skimmer face plate cover attachable to said skimmer face plate; a template having a size and shape proportional to the size and shape of the face plate cover; a water-resistant material bearing a color, pattern, or design; and a wrapper created from the water-resistant material using the template that complements neighboring colors, patterns and designs surrounding the skimmer face plate installation location.

Various methods and means of fabricating, installing and maintaining the pool surface improvements are also disclosed.

DETAILED DESCRIPTION OF EXAMPLE EMBODIMENTS

Interior Pool Surfaces

To overcome the disadvantages of the prior art, the present invention comprises a water-resistant liner such as a vinyl surfaced liner, formed from either a single contiguous sheet or a plurality of segmented portions that are assembled and installed, which mimic the many stylistic advantages of more expensive, permanently applied gunite and ceramic enhanced pool finishings.

In one embodiment, the technology is utilized to produce liners that include the licensed stylings of third-parties in an on-demand fashion, for example, the stylized enhancements of custom designers or a known fashionable flourish. In other embodiments, the designs are customized and comprise, for example, a patterned appearance wherein every $n^{th}$ tile portion (whether an actual segmented portion or a faux tile separation created in appearance only on the surface of the vinyl) a particular pattern or design is repeated.

In further embodiments, the appearance of the vinyl surfaced liner is enhanced with stylized reproduction of the appearance of repetitive or randomized tile patterns, reflective inks, iridescent inks, reflective beads, and other attractive flourishes.

In this manner, a plurality of aesthetically pleasing, cost-effective liners and liner pattern templates are achieved, and the need for traditionally cumbersome, expensive and permanent gunite and ceramic enhanced wall and flooring surfaces is avoided.

Figure 1:
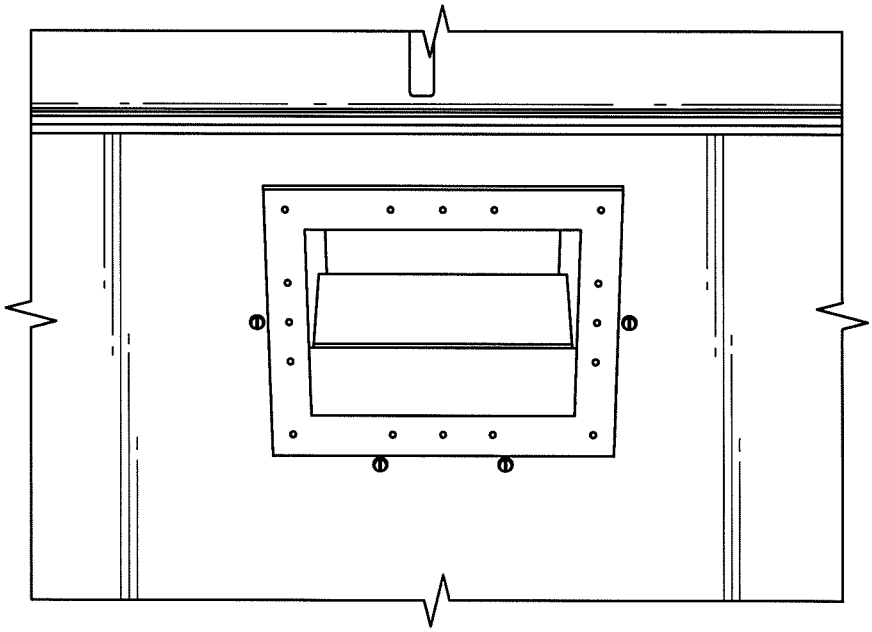
FIG. 1 (Prior Art)
FIG. 1 illustrates an unfinished interior pool surface as is presently known in the art.
Figure 2:
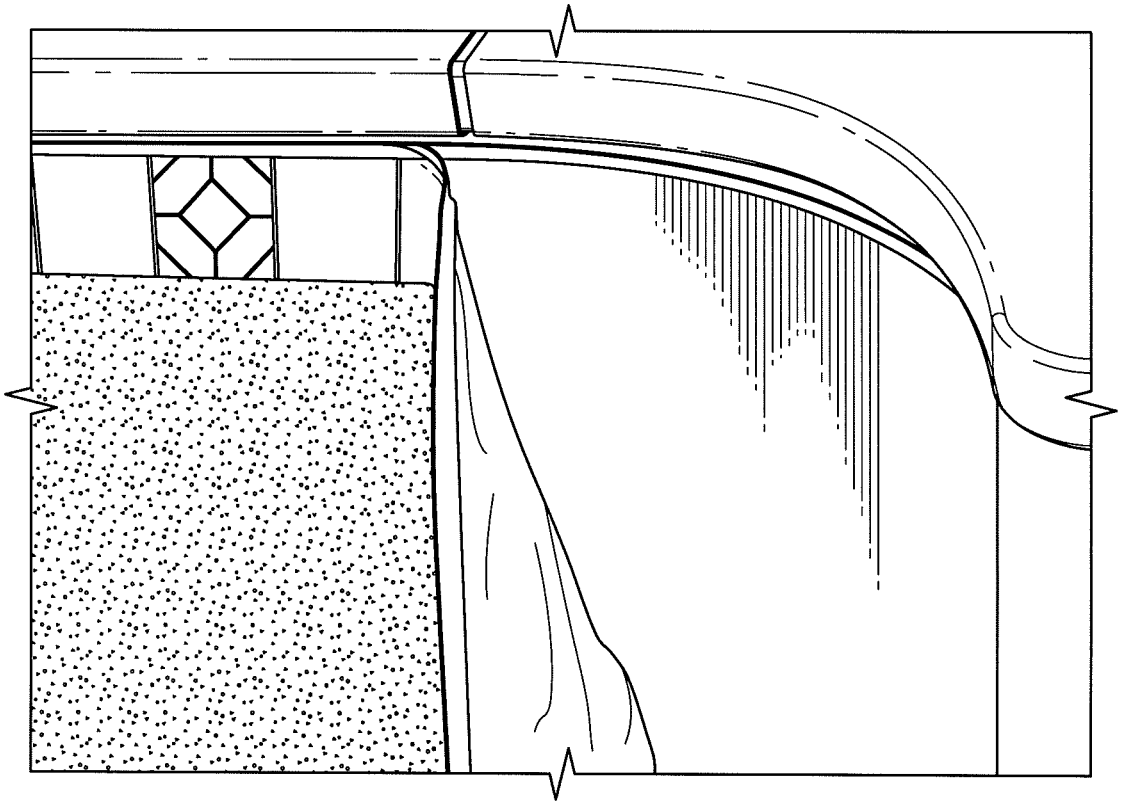
FIG. 2 illustrates the interior surface of the pool depicted in FIG. 1 as equipped and finished with a custom decorative liner, according to an example embodiment.
Figure 3:
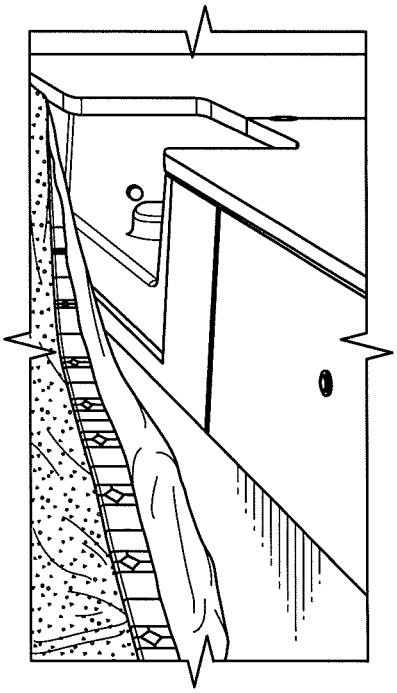
FIG. 3 further illustrates the interior surface of the pool depicted in FIGS. 1 and 2 as further equipped with a custom decorative liner.

With reference now to FIGS. 1-3, FIG. 1 illustrates an unfinished interior pool surface as is presently known in the art. FIGS. 2-3 illustrate the interior surface of the pool depicted in FIG. 1 being customized and finished with a custom decorative liner of the present invention.

Figure 4:
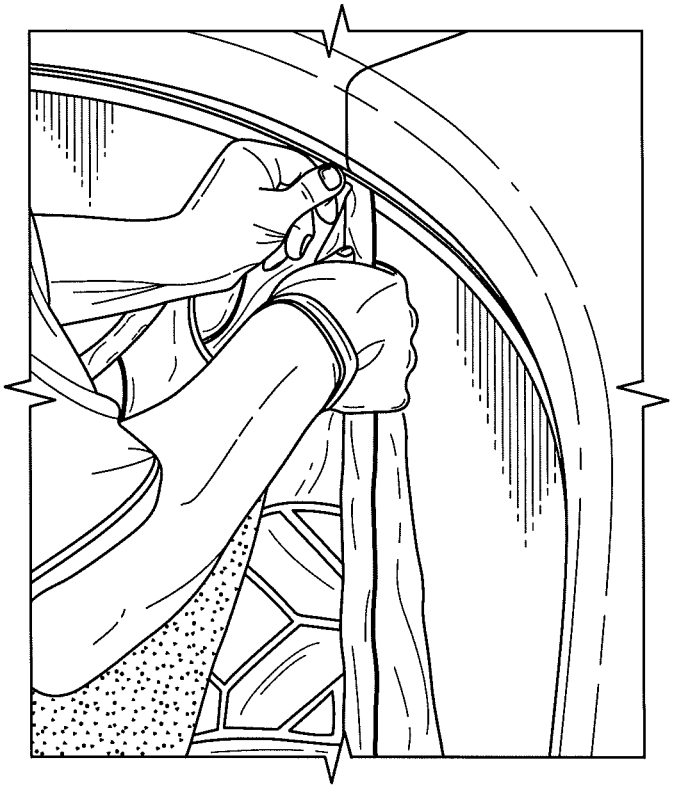
FIG. 4 illustrates the installation of a custom decorative liner, wherein the liner is a bead edge liner with its beaded edge being fed into a track receiver, according to an example embodiment.
Figure 5:
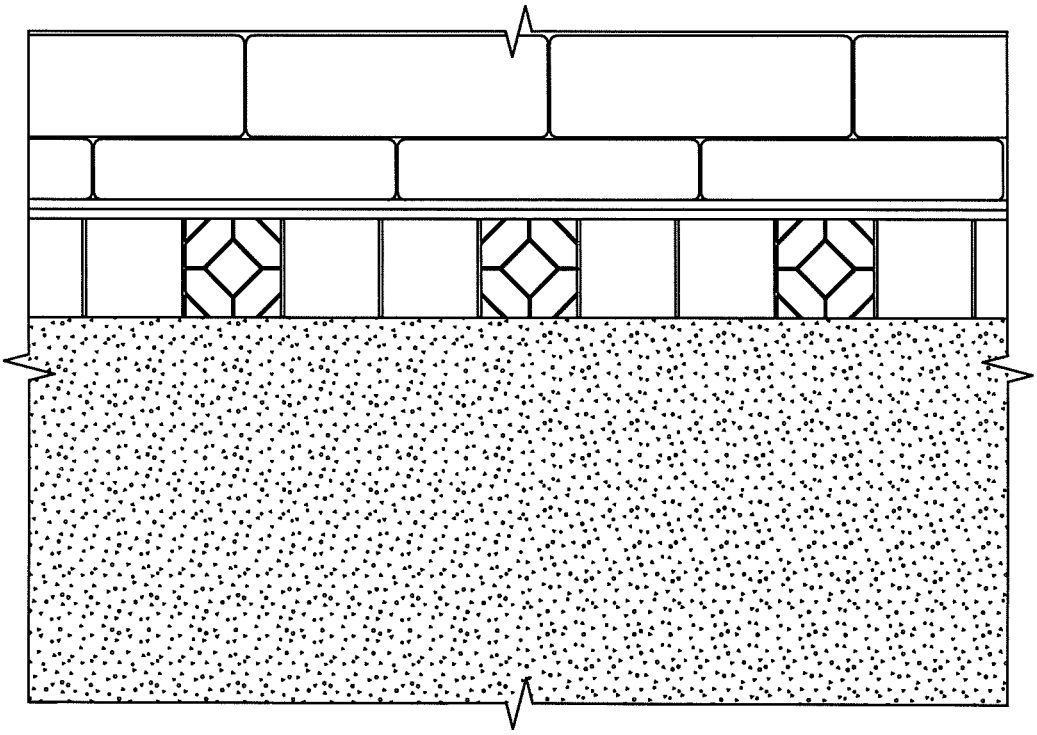
FIG. 5 illustrates the interior surface of the pool depicted in FIGS. 1-4 as customized and finished using the method of the present invention.

Next, FIG. 4 illustrates a bead edged custom liner with its beaded edge being fed into a track receiver. Finally, FIG. 5 illustrates the interior surface of the pool depicted in FIGS. 1-4 as beautifully customized and finished according to the methods and means of the present invention.

In one embodiment, a vinyl surfaced liner is an overlap type pool liner installed by coping strips. The coping strip runs along the top of the pool wall and overlaps the swimming pool wall from the inside, thereby holding the liner securely in place. As installing this type of liner can cause an inconsistent and uneven amount of material overlapping around the pool wall, however, overlap pool liners are often limited to liners with either solid-colored or uniform patterns.

In another embodiment, the vinyl surfaced liner is a snap bead type liner installed by fastening the beaded edge of the liner into a corresponding, receptively configured track receiver installed along the pool wall. The beaded edge is fed into the bead track receiver and secured by manually maneuvering the liner along the length of the bead track receiver, or through the use of various tools generally available to those of ordinarily skill in the art in order to assist in the fastening of the liner to the track.

Again, FIG. 4 illustrates the installation of a custom, decorative liner of the present invention, wherein the liner is a snap bead liner with its beaded edge being fed into the track receiver. Since snap bead liners feed evenly and consistently around pool wall perimeters, such liners easily cooperate with a myriad of aesthetically pleasing decorative patterns, including wall borders and tile trims that require uniform and level liner installations.

In other embodiments, the vinyl surfaced liner is a J-Hook (or V bead) liner. In such embodiments, the J-hook edge or V bead edge of the liner hooks onto the rim of the pool wall, providing a professional grade fitting without an inconsistent excess of material hanging over the edge, as can occur with the aforementioned overlap type liners. Similar to the snap bead liner, a J-Hook or V bead liner attaches evenly and consistently around the pool wall, and thus these liners also admit to a wide variety of aesthetically pleasing decorative patterns, including wall borders and tile trims requiring uniform, level installations.

In a further embodiment, the vinyl surfaced liner is a unibead type liner, which is relatively versatile since it can be used either with a bead track receiver or as a J-Hook liner. Notably, the J-Hook portion of a unibead liner can be removed to convert the J-Hook liner into a standard snap bead type liner. Again, the unibead liner, in either of its configurations, attaches evenly and consistently around the pool wall, and thus these liners also lend to aesthetically pleasing decorative patterns, including wall borders and tile trim requiring uniform, level installations.

In a still further embodiment, the vinyl surfaced liner is an expandable pool liner, preferably made of a durable vinyl that can stretch to fit a variety of pool sizes and configurations. In short, ordinarily skilled artisans will appreciate that the types of pool liners and their attachment means suitable for practice in conjunction with the claimed invention are numerous and varied.

In some embodiments, the vinyl surfaced liner is installed by hanging the liner onto the pool, in accordance with the type of liner being used (e.g., standard bead liner, J-Hook liner, unibead liner, etc.); removing air from behind the hung liner (e.g., by vacuum); positioning the finer and shifting it to eliminate wrinkling and pleating as air is being removed from behind; and then filling the pool with water. In this embodiment, no sealants or adhesives are used to attach the pool liner to the surface of the interior of the pool. Again, those of ordinary skill in the art will appreciate that there are many possible methodologies for installing the pool liner in a manner consistent with the advantages of the claimed invention.

Skimmer Face Plates

Other pool parts and accessories will benefit from the inventive method of finishing pool surfaces disclosed herein. In one particular though non-limiting embodiment, a pool skimmer face plate cover is customized and wrapped in order to refinish its surface.

Customizable pool skimmer face plate covers allow pool owners to cover unsightly skimmer face plates and match or complement them seamlessly to neighboring pool linings. Disclosed herein, for example, are a number of example methods and means for producing custom skimmer face plate covers that admit to further customization of interior pool surfaces. Through use of this efficient associative technology, pool owners' existing skimmer face plates can be easily customized and concealed.

In one example embodiment, a skimmer face plate cover is available in various sizes and shapes equal (or approximately so) to the sizes and shapes needed in order to cover existing skimmer face plates, such as wide mouthed, rectangular skimmer face plates or square skimmer face plates. In one embodiment, the skimmer face plate cover easily covers the pool's existing skimmer face plate by snapping on and off. Those of ordinary skill in the art will appreciate that the options for shapes and sizes of skimmer face plates and their attachment means are numerous and varied.

Figure 6:
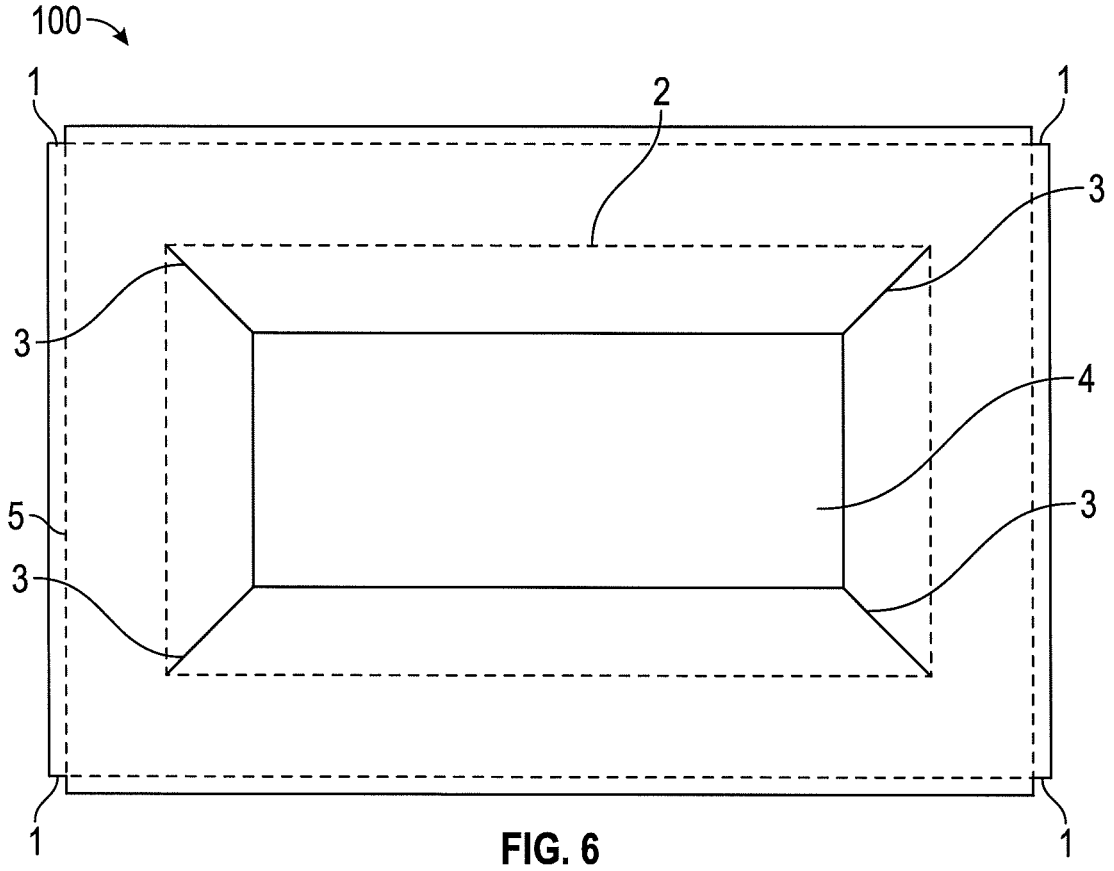
FIG. 6 illustrates a skimmer face plate cover template apparatus, according to an example embodiment.

With reference now to accompanying FIG. 6, the template apparatus in one embodiment comprises a template [100] that is appropriately shaped and sized to fit the skimmer face plate cover to be customized. The template [100] allows the user to produce a correctly sized wrapper in order to wrap the skimmer face plate cover.

In a further embodiment, the template [100] has square cut-outs [1] at the outer, four corners of the template [100]. Said square cut-outs [1] allow the template apparatus to produce a custom wrapper that more easily folds at the corners and wraps around the skimmer face plate cover. Ordinarily skilled artisans will appreciate that the possibilities for specific cuts and other alterations in the template used to produce a wrapper that more easily folds and wraps are numerous and varied.

In another embodiment, the template apparatus is larger than the skimmer face plate cover to be customized, and the template [100] comprises a dotted line [5], or other demarcating indication that corresponds to the actual size and shape of the skimmer face plate cover. In such embodiments, the template is generally larger than the skimmer face plate cover to be customized in order to achieve a custom wrapper that more easily wraps around the skimmer face plate cover.

In yet another embodiment, the template apparatus [100] has an additional dotted line [2], or other demarcating indication corresponding to the location and shape of the skimmer face plate cover's mouth opening. In a further embodiment, the template apparatus has a cut-out [4] located within said mouth opening dotted line, which represents an opening similar in shape but smaller than that of the skimmer face plate cover's actual mouth.

In alternative embodiments, said opening cut-out [4] has diagonal slits [3] disposed from the edge of each of the cut-out's four corners to said mouth opening dotted line [2]. Said diagonal slits [3] allow the template apparatus to produce a custom wrapper that more easily folds at the corners and wraps around the skimmer face plate cover's mouth opening. Those of ordinary skill in the art will appreciate that the possibilities for slits and other alterations in the template used to produce a wrapper that more easily folds and wraps are also numerous and varied.

Figure 7:
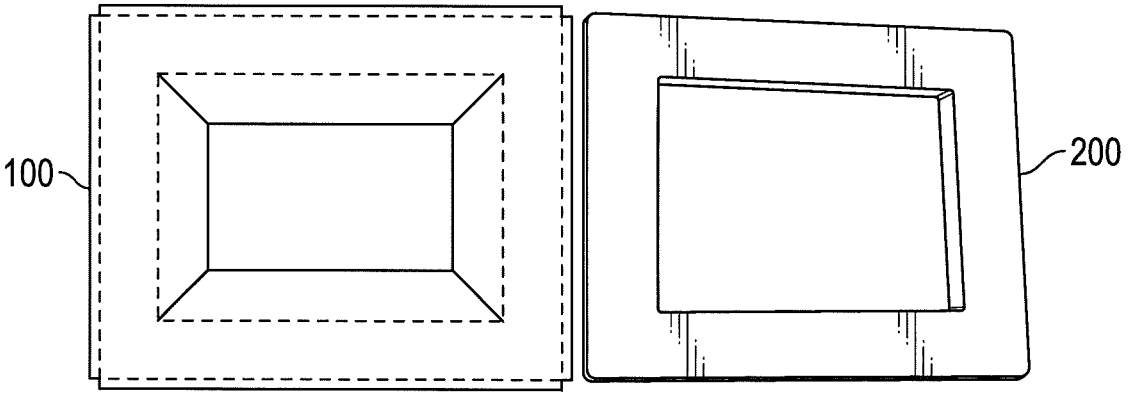
FIG. 7 illustrates the template apparatus depicted in FIG. 6 and a skimmer face plate cover apparatus.

Turning now to FIG. 7, the template apparatus [100] depicted in FIG. 6 is shown next to a skimmer face plate cover [200], according to an example embodiment.

In a related method of use, the installer selects a correctly sized face plate cover and template apparatus that matches the subject skimmer face plate. The user then chooses a vinyl liner or a liner comprising a different or related material that matches the pool's liner or other user preferences (or vice versa).

Figure 8:
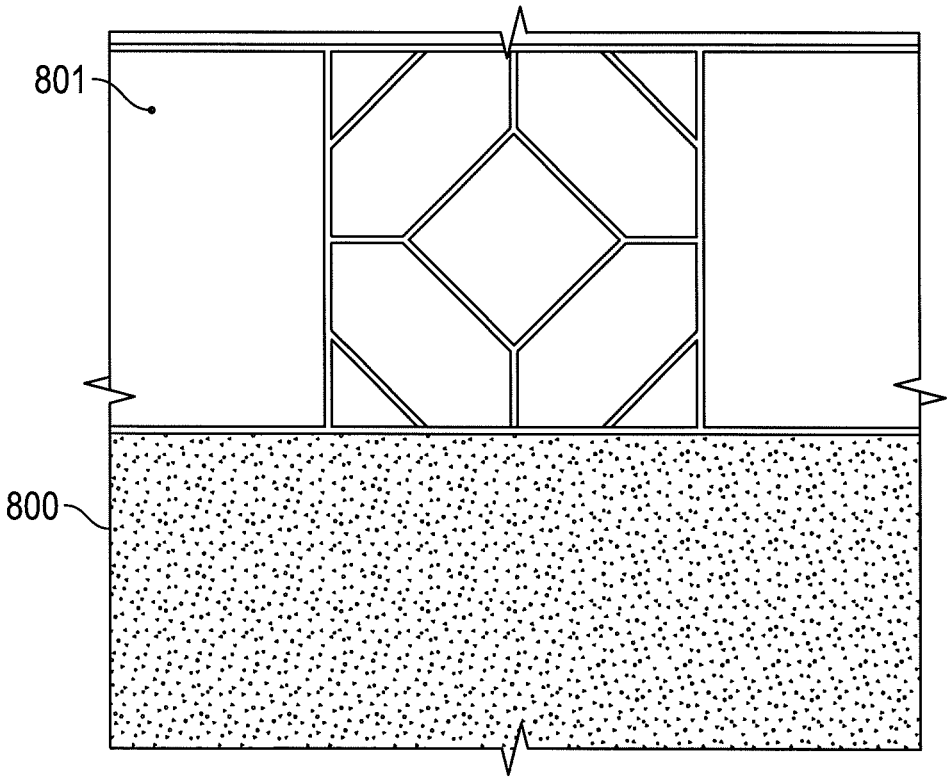
FIG. 8 illustrates an example vinyl surfaced pool liner, to be trimmed using the template apparatus, with a start point marked.
Figure 9:
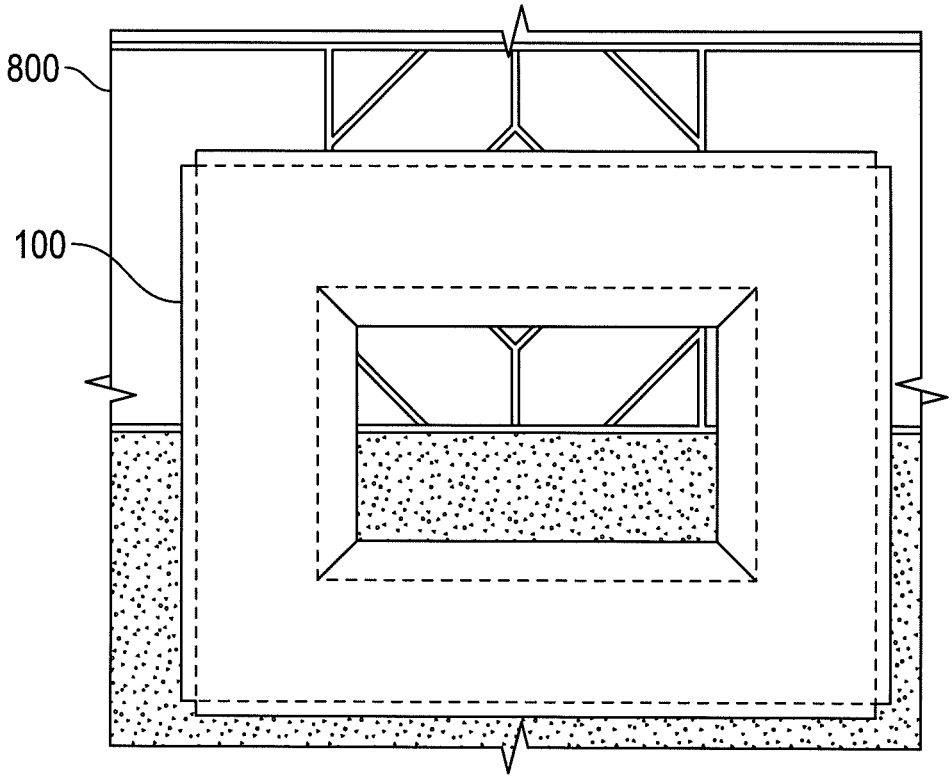
FIG. 9 illustrates the template apparatus placed on top of the example vinyl surfaced pool liner from FIG. 8.
Figure 10:
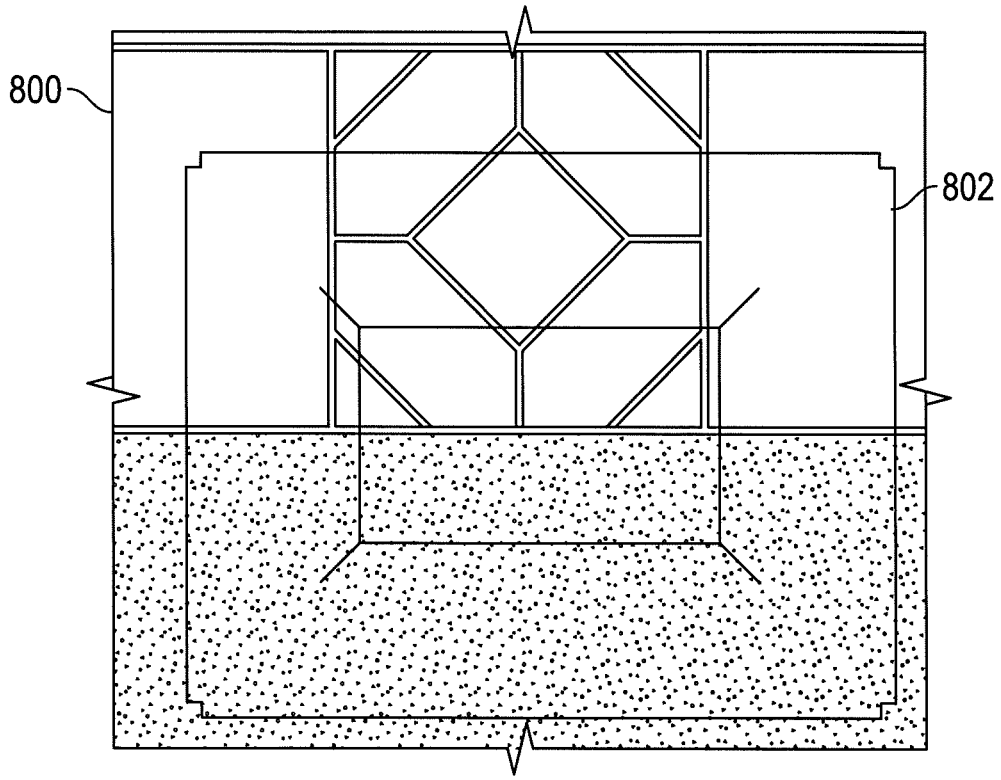
FIG. 10 illustrates tracings made on the example vinyl surfaced pool liner using the template apparatus.
Figure 11:
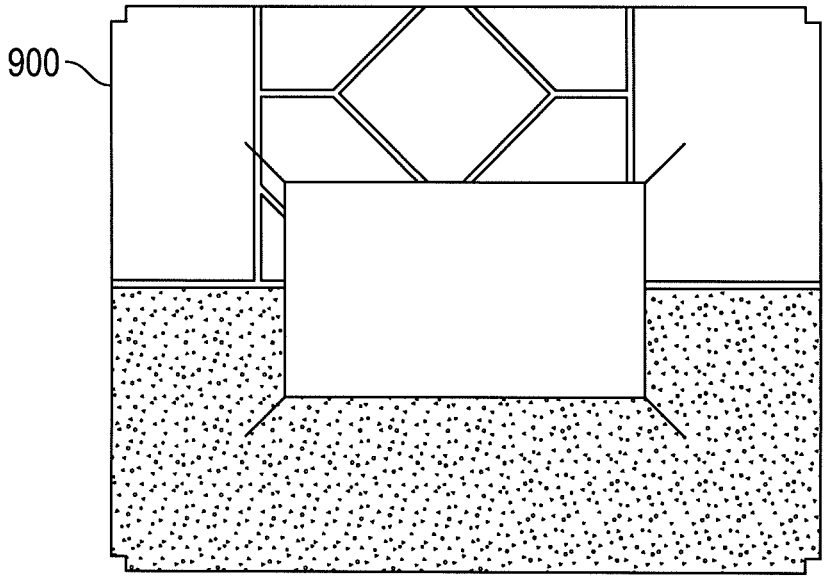
FIG. 11 illustrates the chosen example surfaced pool liner trimmed following the tracings from FIG. 10.
Figure 12:
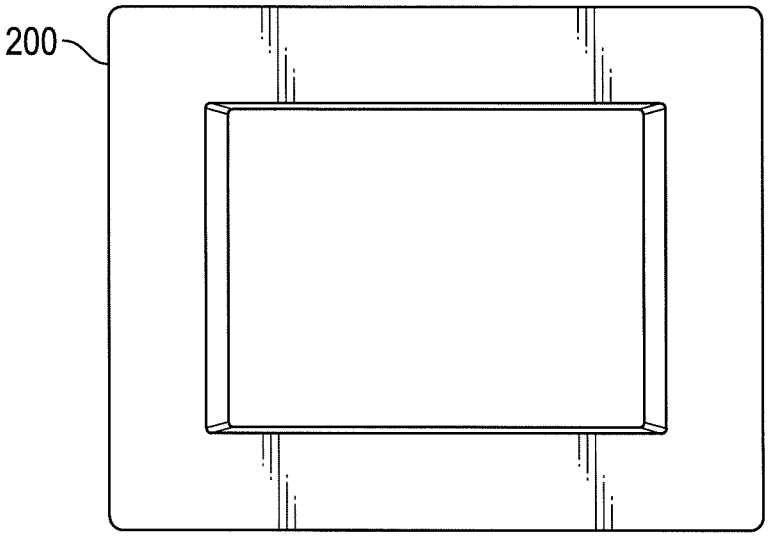
FIG. 12 illustrates an unwrapped skimmer face plate cover apparatus that is capable of being snapped onto an existing skimmer face plate.

In one embodiment the user establishes a starting point [801] on the liner's pattern [800] [see FIG. 8], such that the covered skimmer face plate will match and align almost perfectly with the surrounding liner pattern. The template [100] is placed on top of the vinyl surfaced liner [800] [see FIG. 9], or another desired liner. The user then traces the template, including the cut-outs and/or slits, creating a tracing [801] [FIG. 10], and lifts and removes the template from the liner and trims the liner along the tracing [801], creating a custom skimmer face plate cover wrapper [900] [FIG. 11].

Figure 13:
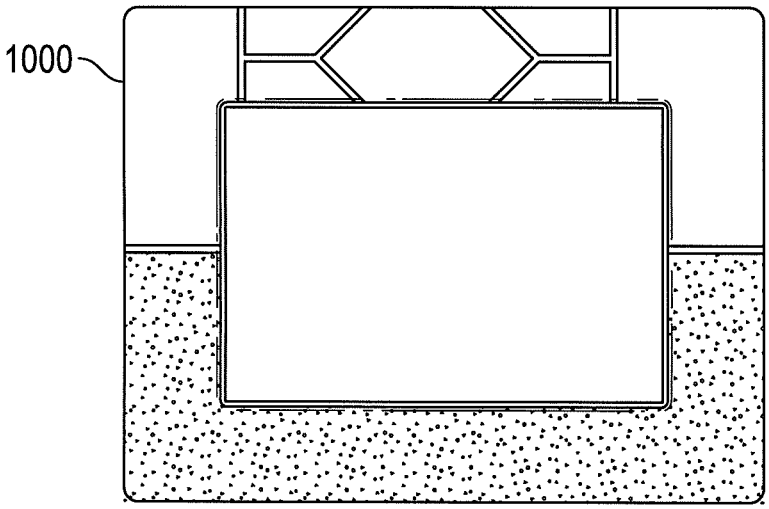
FIG. 13 illustrates a customized skimmer face plate cover apparatus wrapped in a vinyl surfaced pool liner that was trimmed using the template apparatus.
Figure 14:
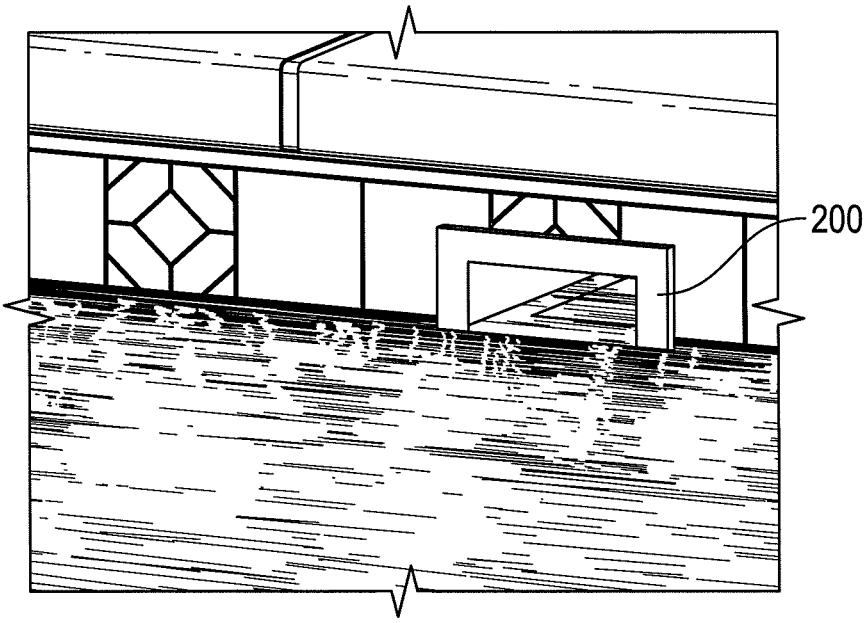
FIG. 14 illustrates an example of an unwrapped skimmer face plate cover in a pool.

In this manner, a custom skimmer face plate cover wrapper [900] is achieved that is correctly sized and shaped. The user then takes the custom skimmer face plate cover wrapper [900] and wraps it around the skimmer face plate cover [200] accordingly, creating a wrapped skimmer face plate cover [1000] [FIG. 13].

In some embodiments, the custom wrapper is affixed in place around the skimmer face plate cover using a waterproof, adhesive method compatible with the material of the liner used. In other embodiments, the wrapper material includes an adhesive backing for gluing the wrapper onto the skimmer face plate cover. In yet other embodiments, the adhesive is independent of the wrapper and applied separately. In further embodiments, the adhesive is an adhesive glue, gel, spray, tape, or similarly compatible material. Those of ordinary skill in the art will readily appreciate that the vast number of ways to affix the liner to the skimmer face plate cover are abundant and varied.

Figure 15:
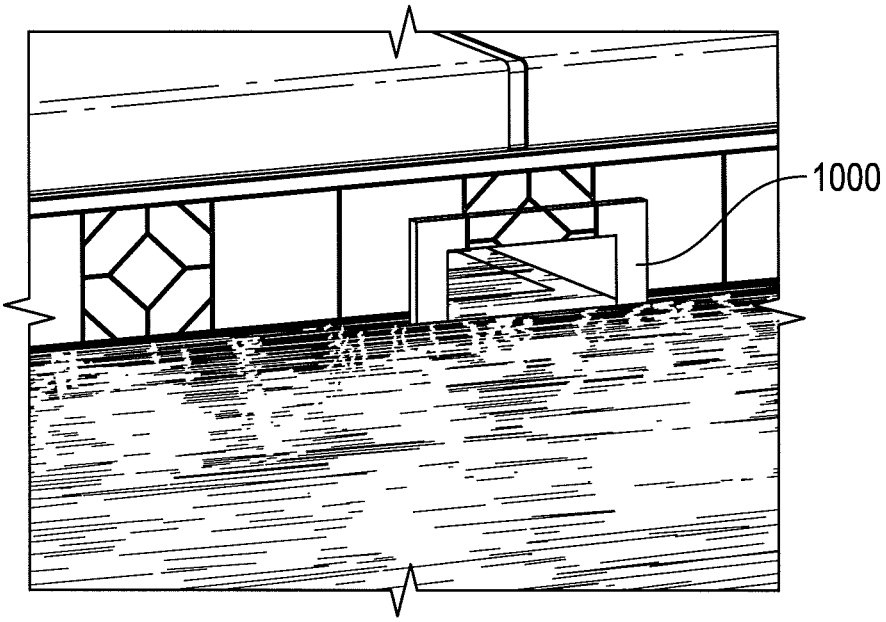
FIG. 15 illustrates the skimmer face plate cover fastened to a surface of a skimmer face plate, wherein the skimmer face plate cover is wrapped in a vinyl surfaced pool liner that was trimmed using the template apparatus.

In a final example embodiment, the skimmer face plate cover is wrapped and then set in place, and the wrapped skimmer face plate cover apparatus [1000] is snapped on to the user's pool skimmer face plate [FIG. 15].

The foregoing specification is provided for illustrative purposes only, and is not intended to describe all possible aspects of the present invention. Moreover, while the invention has been shown and described in detail with respect to several exemplary embodiments, those of ordinary skill in the pertinent arts will appreciate that minor changes to the description, and various other modifications, omissions and additions may also be made without departing from either the spirit or scope thereof.

The invention claimed is:

1. A vinyl surfaced liner for customizing and finishing an interior pool surface, comprising:

a water resistant expandable vinyl material that can stretch to fit a plurality of pool sizes and configurations, comprising a vinyl surface;

a predetermined decorative pattern or design, wherein the decorative pattern or design is applied onto at least one side of the liner by either a digital printing process or a screen printing process, and wherein the pattern is applied in a manner that avoids interruptions; and a plurality of attachment points positioned along an upper outer edge of the liner and configured to attach and hang the liner along a pool wall rim.

2. The liner of claim 1, further comprising: a decorative pattern or design comprising a three-dimensional decorative indicia.

3. The liner of claim 2, further comprising: a decorative pattern or design comprising one or more of a pebble and a bead.

4. The liner of claim 3, further comprising: a decorative pattern or design comprising one or more of a reflective pebble and a reflective bead.

5. The liner of claim 1, further comprising: a decorative pattern or design comprising one or more of an iridescent ink and a reflective ink.

6. The liner of claim 1, further comprising: a decorative pattern or design comprising a wall border and a tile trim.

7. The liner of claim 6, further comprising: a decorative pattern or design comprising a patterned appearance wherein every $n^{th}$ tile, whether an actual tile segment or a simulated tile separation appearance created on a surface of said liner, repeats said pattern or design.

8. The liner of claim 1, further comprising: a randomly distributed decorative pattern or design.

* * * * *